United States Patent [19]

Seiverling

[11] 4,050,442

[45] Sept. 27, 1977

[54] EMERGENCY MANTLE LAMP FOR A GAS STOVE

[75] Inventor: John S. Seiverling, Nashville, Tenn.

[73] Assignee: Aladdin Industries, Incorporated, Chicago, Ill.

[21] Appl. No.: 664,379

[22] Filed: Mar. 5, 1976

[51] Int. Cl.[2] ..... F24C 15/00

[52] U.S. Cl. ..... 126/213; 126/48; 431/110

[58] Field of Search ..... 126/38, 43, 44, 47, 126/48, 235, 255, 213; 431/100, 110, 111

[56] References Cited

U.S. PATENT DOCUMENTS

| | | | |
|---|---|---|---|
| 1,100,471 | 6/1914 | Burkley | 431/110 |
| 1,411,273 | 4/1922 | Guelbaum | 431/110 |
| 3,324,687 | 6/1967 | Swinyar | 431/100 X |

*Primary Examiner*—Edward G. Favors

*Attorney, Agent, or Firm*—McDougall, Hersh & Scott

[57] ABSTRACT

An emergency mantle lamp is disclosed for use with a gas stove. The mantle lamp is adapted to be placed over a gas burner on a stove top. When the gas is turned on a perforated conical base conducts the flame upwardly to a formed mantle surrounded by a glass chimney. The mantle heated by the flame emits a fairly bright light for illuminating a room.

5 Claims, 3 Drawing Figures

EMERGENCY MANTLE LAMP FOR A GAS STOVE

BACKGROUND OF THE INVENTION

The present invention relates to gas burning mantle lamps. More specifically, it relates to emergency lamps which are portable and which are not permanently connected to a source of fuel. Such lamps have application both in the home and during camping. A mantle lamp is generally understood to be one in which a supply of gas or similar combustible fluid is provided to a fabric or formed mantle which, when ignited, produces a light emitting glow. The heated mantle body produces a high percentage of visible light useful for illuminating a camping area or a room. In recent years electrical brown outs and outages have occurred with some frequency. In such situations it is desirable to provide some emergency light source which is both inexpensive to purchase and maintain and which is reliable.

It is accordingly an object of the present invention to provide an emergency mantle lamp for use in conjunction with a gas burning stove.

It is another object of the present invention to provide an emergency lamp for use during an electrical outage.

It is another object of the invention to provide a portable mantle lamp which can convert a gas cooking stove safely into an emergency lighting source.

Other objects and advantages of the invention will become apparent from the remaining portion of the specification.

DETAILED DESCRIPTION

Figure 2:
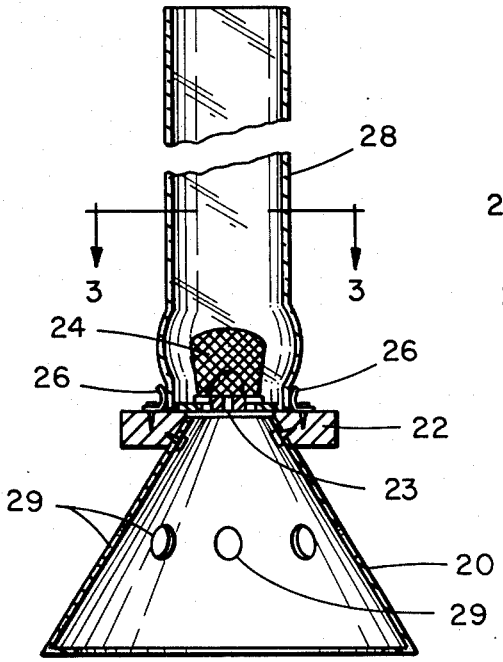
FIG. 2 is a side elevation through a section of the lamp illustrating the details thereof.
Figure 3:
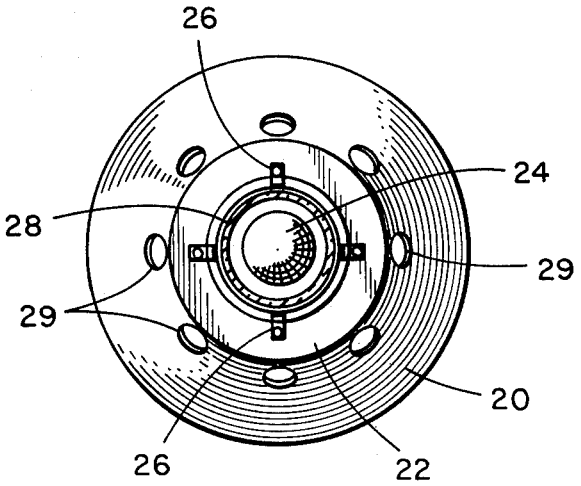
FIG. 3 is a plan view along the lines 3-3 of FIG. 2.
Figure 1:
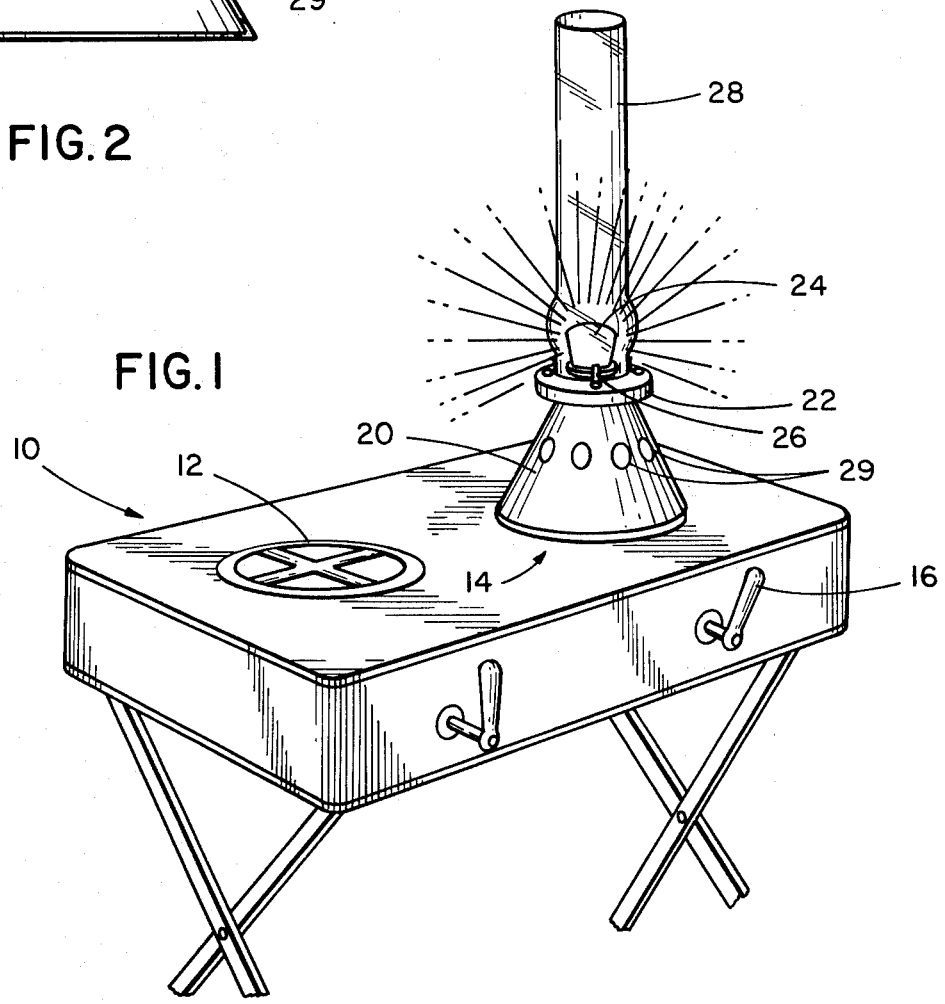
FIG. 1 is a perspective view of a gas cooking stove in which the mantle lamp according to the present invention has been placed thereon.

Referring to the drawings, the portable emergency mantle lamp according to the invention is illustrated. As indicated in FIG. 1, the lamp is for use in conjunction with a gas cooking stove, such as stove 10. By gas cooking stove it is meant any gas cooking device which is provided with a source of natural gas or similar fuel, which source of fuel is provided to a generally circular burner unit for ignition to provide cooking heat. In FIG. 1 there is illustrated a portable cook stove 10 having two burners 12 and 14. It will be apparent that the lamp is equally useful over a gas burner operated by knobs 16 whereby movement of the knobs is effective for permitting or preventing release of gas from the source to the burner. In the case of an outdoor stove, it is generally necessary to ignite the gas by applying a match to the burners while in a home range there is usually a pilot light for automatically igniting the gas when the valve 16 is operated. When the emergency lamp of the present invention is in use, an outdoor burner is ignited with a match. In the case of a home range the pilot light ignites the burner.

The mantle lamp according to the invention employs a perforated conical converting base 20 and a mating disc 22 for joining the base to a formed upright mantle 24. Also provided on the disc 22 are a plurality of spring clips 26 for securing a glass chimney 28 in position about the mantle 24. The perforated conical base 20 is provided to adapt the gas burner of a cooking stove for use with the mantle lamp. The perforated conical base is preferably formed from a lightweight ceramic as, for example, a formed aluminum silicate fiber felt. The base directs the flame from the burner through an opening in the disc to the mantle 24. Perforations 29 are provided in the conical base to provide secondary air for combustion and to set up an upward draft of the flame to the mantle 24. The size, number and spacing of the perforations is not critical. All that is required is that an adequate air supply be provided. Preferably the perforations are located above the height of the flame from the burner in normal use.

A central opening 23 is provided in the disc 22 to permit the upward passage of the flame from the burner through the base to the mantle 24. The formed upright mantle and the glass chimney 28 are of conventional construction. Spring clips 26 are secured to the disc, preferably four, spaced 90 degrees apart. The clips permit the removal of the clear glass chimney for replacement of the mantle 24, if necessary, and subsequent restoration of the chimney over the mantle during use of the lamp.

In operation the device is utilized either at a camping site during the evening hours or in a home during an electrical outage. The perforated conical base 20 is placed over a cooking stove burner, the gas is turned on as by valve 16 in FIG. 1 and ignited by the pilot permitting an upward flow of the flame from the burner area past the perforated conical base to the mantle 24. Regulation of the intensity of the mantle 24 can be accomplished by regulating the amount of gas permitted to flow to the burner 14 via valve 16.

After use the lamp is simply removed from the burner and stored for future use with minor cleaning, if necessary. As with conventional mantle lamps, the mantle 24 produces a good deal of visible light which is adequate for providing room illumination during an electrical outage or at a campsite.

While I have shown and described embodiments of this invention in some detail, it will be understood that this description and illustrations are offered merely by way of example, and that the invention is to be limited in scope only be the appended claims.

I claim:

1. In combination with a gas cooking stove having a burner a portable lamp for converting a burner of said stove to a source of light, said lamp comprising:

a. a formed upright mantle to produce light when heated, b. a conically shaped hollow base having perforations therethrough open at its top and bottom and dimensioned to cover the burner for conveying the gas flame from an ignited stove burner to the mantle, c. a transparent chimney open at the top positioned about said mantle, and d. connecting means for securing the base and chimney to the mantle.

2. A device according to claim 1 wherein said base is a conical section formed of a ceramic material.

3. A device according to claim 1 wherein said connecting means includes a disc shaped member on which said mantle is mounted having a central opening to permit passage of the flame to said mantle.

4. A device according to claim 3 wherein said disc is secured to said base.

5. A device according to claim 3 wherein said disc has at least two spring clips mounted on the top side thereof for releasably securing said chimney thereto.

* * * * *